US005669828A

United States Patent [19]

Schmidt

[11] Patent Number: 5,669,828

[45] Date of Patent: Sep. 23, 1997

[54] GOLF CLUB METALLIC HEAD FORMATION

[75] Inventor: Glenn H. Schmidt, Malibu, Calif.

[73] Assignee: Callaway Golf Company, Carlsbad, Calif.

[21] Appl. No.: 690,761

[22] Filed: Aug. 1, 1996

Related U.S. Application Data

[62] Division of Ser. No. 436,020, May 5, 1995, Pat. No. 5,577,550.

[51] Int. Cl.[6] ..... A63B 53/04

[52] U.S. Cl. ..... 473/345; 473/346

[58] Field of Search ..... 473/345, 346, 473/347, 350, 324, 327

[56] References Cited

U.S. PATENT DOCUMENTS

| | | | |
|---|---|---|---|
| 2,948,031 | 8/1960 | Webb . | |
| 3,172,667 | 3/1965 | Baker et al. . | |
| 3,468,544 | 9/1969 | Antonious | 473/327 |
| 3,794,328 | 2/1974 | Gordon | 473/327 |
| 3,849,053 | 11/1974 | Bruce et al. . | |
| 3,856,256 | 12/1974 | Celesti . | |
| 3,974,997 | 8/1976 | Bolton . | |
| 4,383,819 | 5/1983 | Letica . | |
| 4,420,447 | 12/1983 | Nakashima . | |
| 4,429,879 | 2/1984 | Schmidt | 473/346 |
| 4,432,549 | 2/1984 | Zebelean | 473/346 |
| 4,472,092 | 9/1984 | Schmidt . | |
| 4,630,825 | 12/1986 | Schmidt | 473/345 |
| 4,650,626 | 3/1987 | Kurokawa . | |
| 4,681,321 | 7/1987 | Chen | 473/346 |
| 4,731,014 | 3/1988 | Von Holdt . | |
| 4,765,585 | 8/1988 | Wieder . | |
| 4,768,747 | 9/1988 | Williams et al. . | |
| 4,811,778 | 3/1989 | Allen et al. . | |
| 4,832,307 | 5/1989 | Watanabe et al. . | |
| 4,842,243 | 6/1989 | Butler . | |
| 4,880,047 | 11/1989 | VanRens . | |
| 4,883,623 | 11/1989 | Nagamoto et al. . | |
| 4,993,475 | 2/1991 | Yamada . | |
| 5,054,784 | 10/1991 | Collins | 473/327 |
| 5,204,046 | 4/1993 | Schmidt . | |
| 5,219,408 | 6/1993 | Sun . | |
| 5,261,478 | 11/1993 | Sun . | |
| 5,296,308 | 3/1994 | Caccavale et al. . | |
| 5,366,222 | 11/1994 | Lee | 473/345 |
| 5,398,746 | 3/1995 | Igarashi . | |
| 5,524,698 | 6/1996 | Chen et al. . | |

FOREIGN PATENT DOCUMENTS

| | | |
|---|---|---|
| 3230845 | 10/1991 | Japan . |
| 5104197 | 4/1993 | Japan . |
| 1222407 | 4/1986 | U.S.S.R. . |

OTHER PUBLICATIONS

Japanese Patent Application No. TokuGan Hei 2-25633 dated Feb. 5, 1990 for "A Mono Block Titanium Alloy--Made Golf Club".

Japanese Patent Application No. TokuGan Hei 5-209511 dated Aug. 24, 1993 for "The Manufacturing Method of a Golf Club Head & the Mold Used in the Manufacturing Method".

*Primary Examiner*—Sebastiano Passaniti

*Attorney, Agent, or Firm*—William W. Haefliger

[57] ABSTRACT

In the method of forming a hollow metallic golf club head having wall structure defining a front wall, a heel, a toe, a rear wall, a sole, and a top wall, the steps that include providing a wax shell covered preformed core body, the thickness of the wax shell corresponding to the desired thickness of the wall structure, forming a ceramic shell about the wax shell; removing the wax shell by melting the wax, thereby to form an opened gap between the ceramic shell and the core body, and casting molten metal into the opened gap, thereby to form the wall structure extending about the core body and at the sole, while forming and maintaining port structure through the wall structure and spaced from the sole, and allowing the wall structure to solidify to form the head; removing the ceramic shell from the wall structure, and removing the core body from the interior of the solidified head, and via the port structure.

5 Claims, 5 Drawing Sheets

GOLF CLUB METALLIC HEAD FORMATION

This is a division of application Ser. No. 08/436,020, filed May 5, 1995, now U.S. Pat. No. 5,577,550.

BACKGROUND OF THE INVENTION

This invention relates generally to forming of hollow, metallic golf club heads, and more particularly to use of a core body in such manner in a lost wax process as to eliminate need for forming a large opening at the sole region of the cast metal head.

At the present time, golf club metal heads are typically formed by casting metal about a core body, and in such manner that a large opening is formed at the head sole region. A separate sole plate is subsequently welded to the head to cover that opening. The weld extends in a large loop, and is the source of problems that include undesirable weight differentiations as between heads during their manufacture; weld variations around the loop; possible weld cracking during shock loading upon head high speed impact with a golf ball; and difficulties encountered during the welding process due to very thin walls being weld connected. There is need for method and means to overcome such problems.

SUMMARY OF THE INVENTION

It is a major object of the invention to provide apparatus and head fabrication methods which overcome such problems. Basically, the method of the invention includes the steps:

a) providing a wax shell covered pre-formed, club head shaped core body, the wax shell covering the score body sole area, the thickness of the wax shell corresponding to the desired thickness of the head wall structure, b) forming a ceramic shell about the wax shell, c) removing the wax shell by melting the wax, thereby to form an opened gap between the ceramic shell and the core body, d) and casting molten metal into the opened gap, thereby to form the wall structure extending about the core body including the core body sole area, while forming and maintaining port structure through the wall structure and spaced from the sole, and allowing the wall structure to solidify to form the head, e) removing the ceramic shell from the wall structure, and removing the core body from the interior of the solidified head, and via the port structure.

As will appear, the core body is pre-formed and may typically consist of molded ceramic material.

It is another object of the invention to provide the port structure to extend through the head rear wall; and that port structure is typically formed to have an overall size substantially less than the overall size of the sole. Multiple small access ports may be formed through the head rear wall, where stresses arising during head impact with a golf ball are substantially less than at other regions of the head wall structure. Such small ports may be closed by welding small closures to the head.

A further object includes casting formations of a metallic sole that defines a medial ridge and two dished recesses at opposite sides of said ridge, the multiple access ports formed rearwardly of said dished recesses.

An additional object includes providing the core body to define an elongated recess sunk in the surface of the core body and corresponding to an elongated stiffener rib to be formed by the head wall structure at the interior side thereof. The multiple access ports formed through the head rear wall are typically located at opposite sides of a plane defined by the stiffener rib.

Another object includes providing multiple core body positioning stand-offs to extend in the gap between the core bodyand the ceramic shell. Such stand-offs are typically provided during the formation of the ceramic shell about the wax shell.

A further object includes provision of the wax shell covered core body by:

i) providing a preformed core body as referred to and having the general shape of the head, ii) positioning that body within a cavity formed by mold structure, thereby to provide an initial gap about the core body, iii) and filling wax into the initial gap to cover the core body and to form the wax shell.

These and other objects and advantages of the invention as well as the details of an illustrative embodiment and method, will be more fully understood from the following specification and drawings, in which:

DRAWING DESCRIPTION

Figure 3:
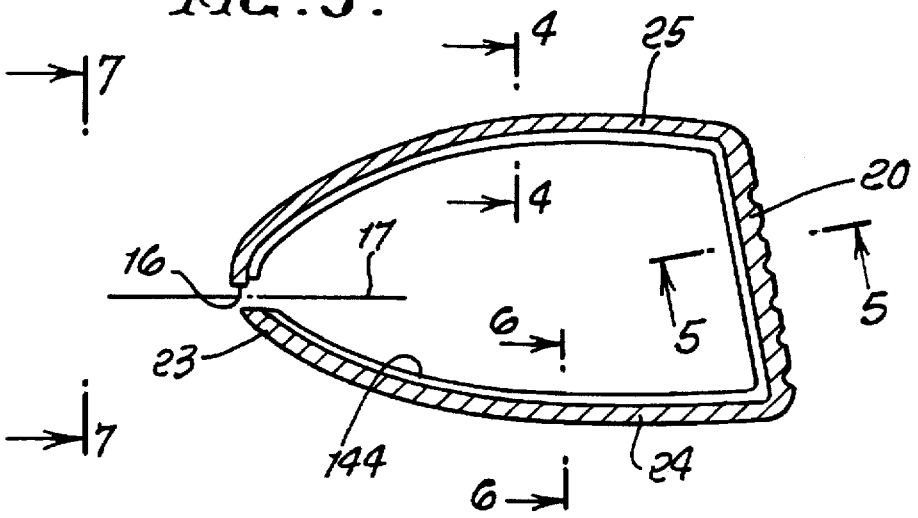
FIG. 3 is a section taken on lines 3—3 of FIG. 2.
Figure 4:
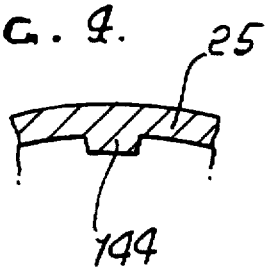
Figure 5:
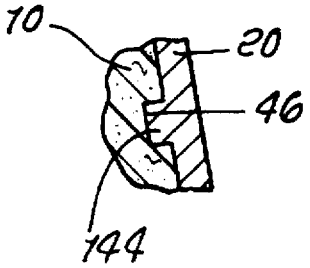
Figure 6:
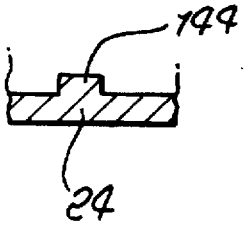
Figure 7:
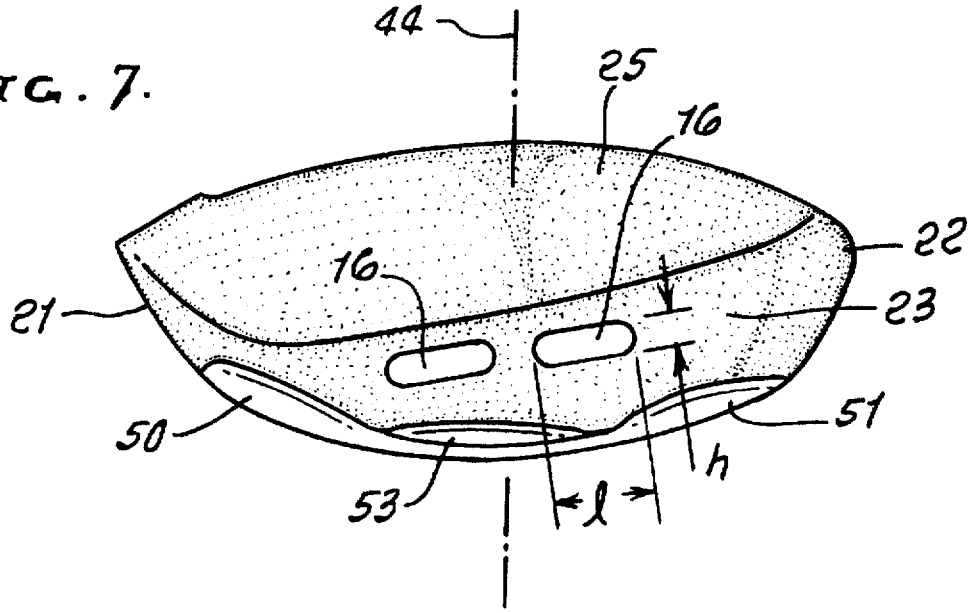
Figure 8A:
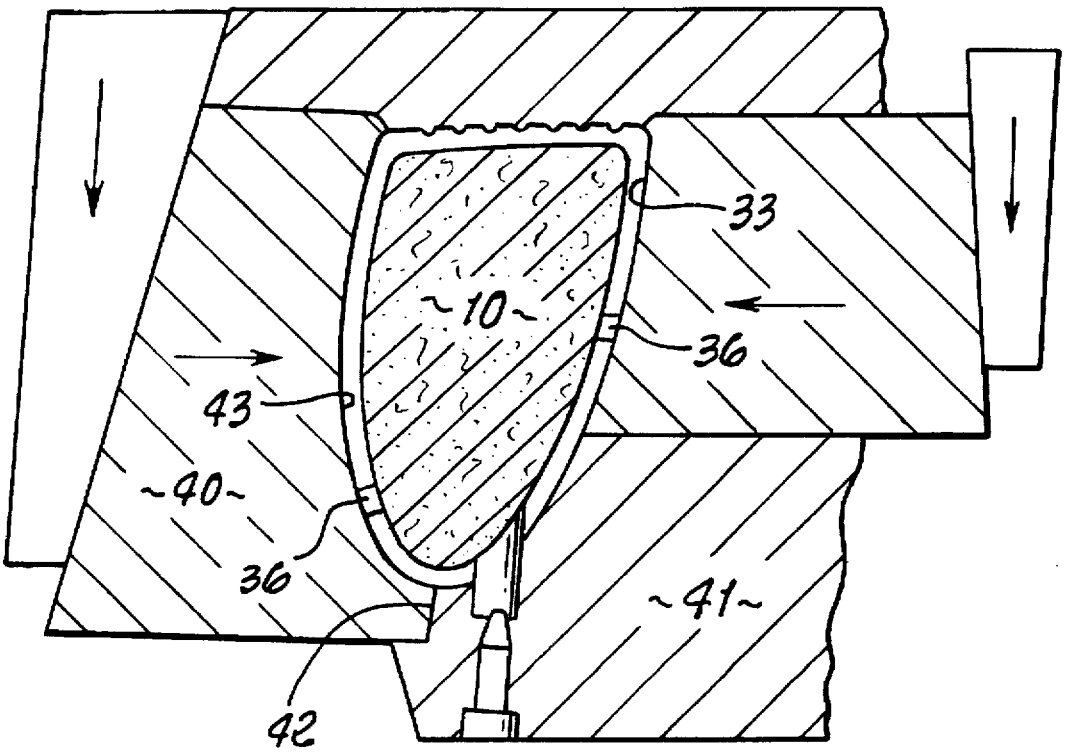
Figure 8:
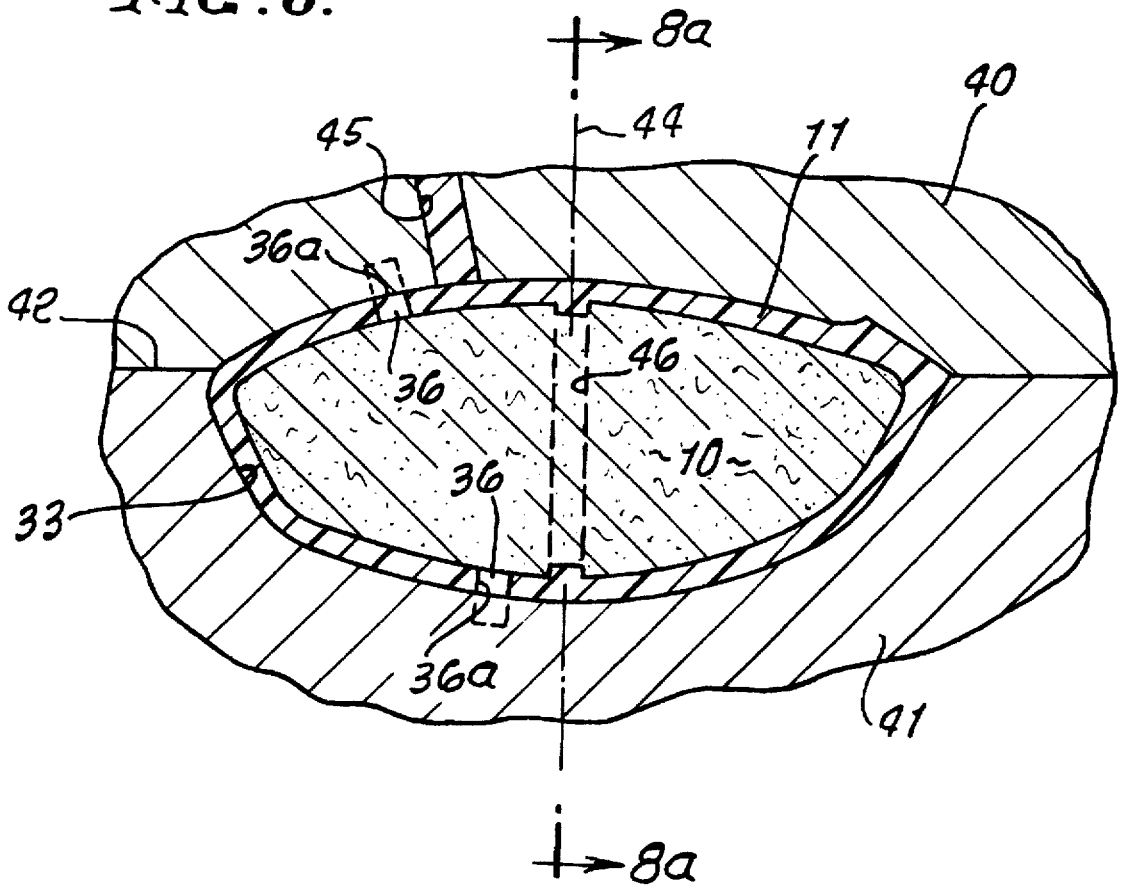
Figure 9:
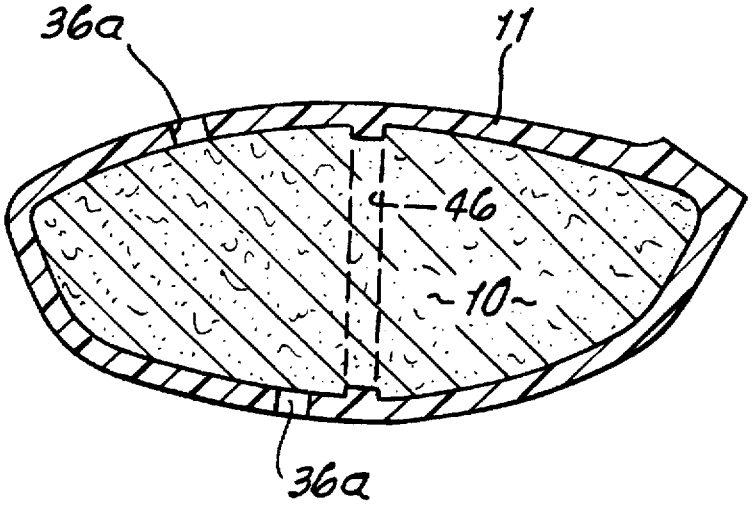
Figure 10:
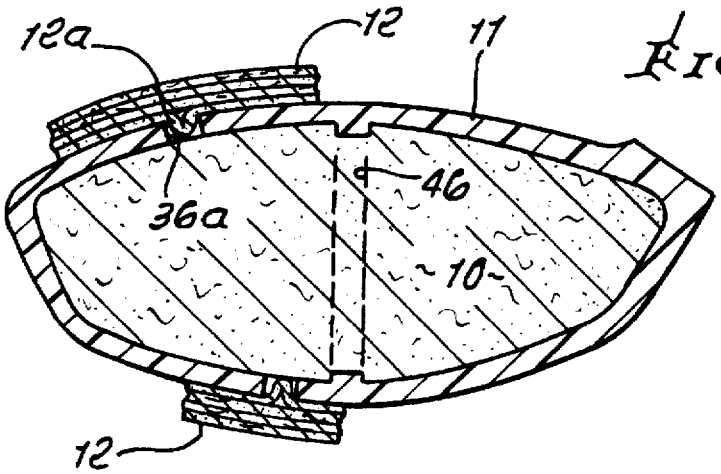
Figure 11:
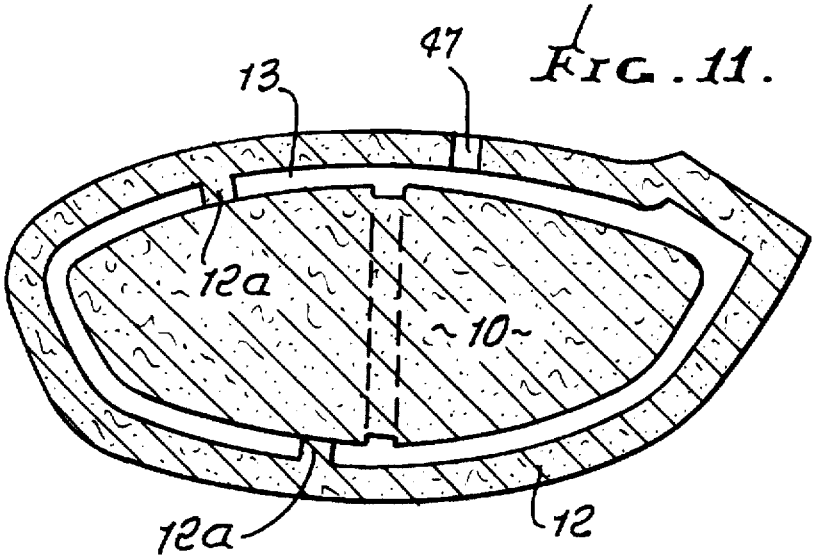
Figure 12:
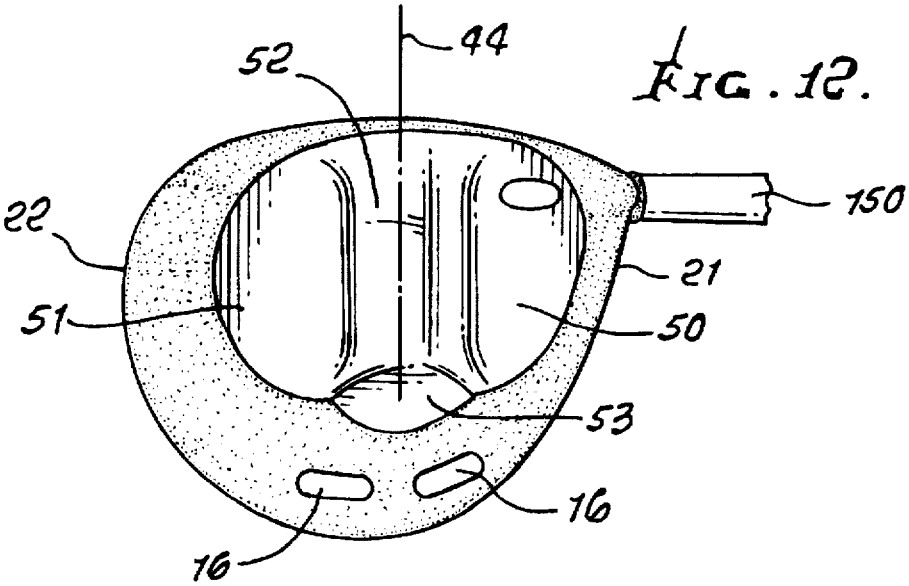

FIGS. 4, 5 and 6 are enlarged sections taken on lines 4—4, 5—5 and 6—6 of FIG. 3;

FIG. 7 is a rear view elevation taken on lines 7—7 of FIG. 3;

FIG. 8 is a vertical section taken through a mold showing formation of a wax shell about a pre-formed mold body;

FIG. 8*a* is a section taken on lines 8*a*—8*a* of FIG. 8;

FIG. 9 is a view like FIG. 8, showing the wax shell covered core body after removal from the mold;

FIG. 10 is a view like FIG. 8, but showing formation of a ceramic shell about the wax shell covered core body;

FIG. 11 is a view like FIG. 10, showing the ceramic shell extending about the pre-formed core, after wax has been removed to form a gap for receiving molten metal forming the golf club head; and FIG. 12 is a bottom plan view of a hollow metallic head, with ports in the rear wall.

DETAILED DESCRIPTION

Figure 1:
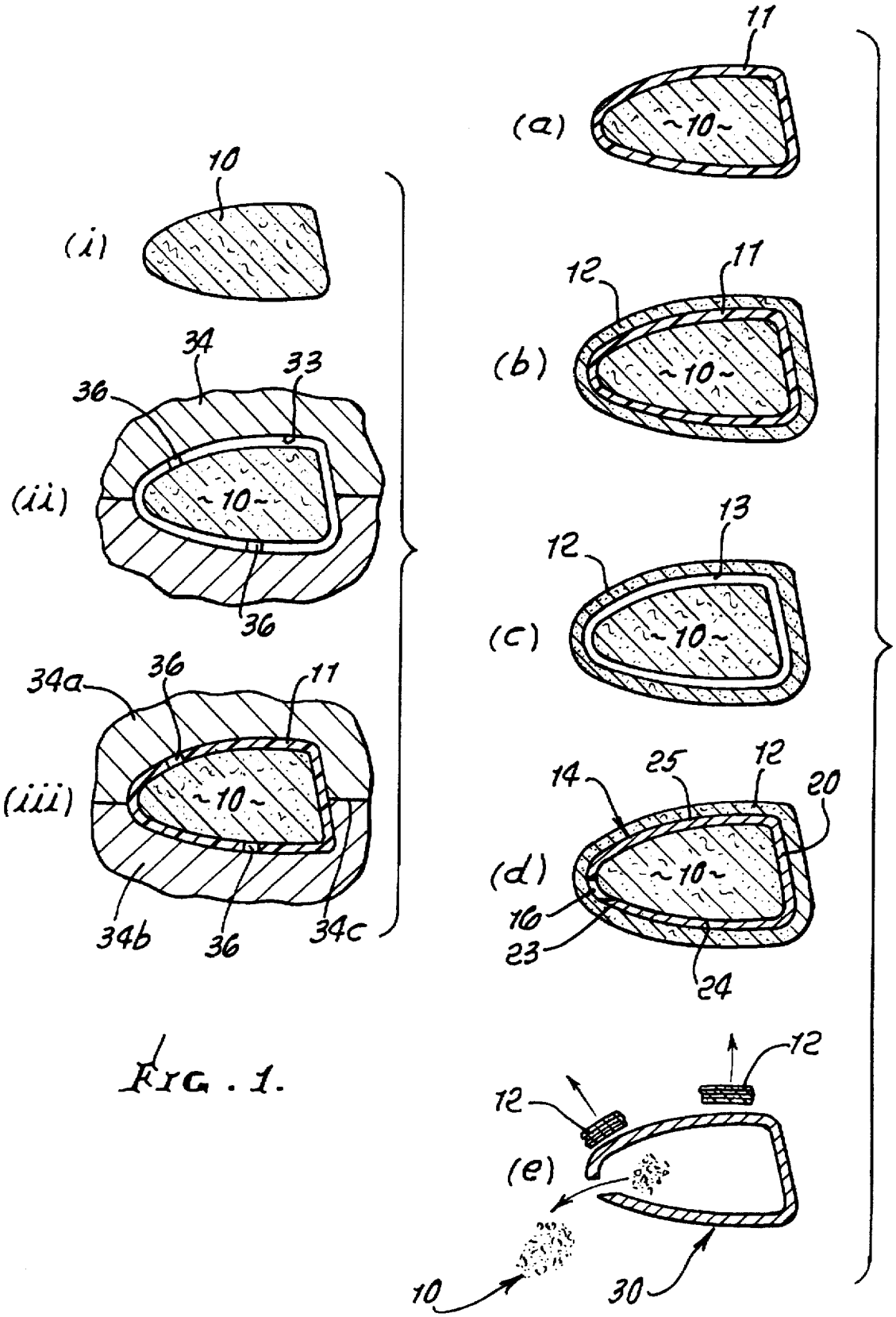
FIG. 1 is a flow diagram.

Referring first to FIG. 1, the illustrated flow diagram, basically includes steps (a)–(e), where step (a) may for example be accomplished by performing preliminary steps i)–iii).

Step a) designates the providing of a wax shell covered, pre-formed core body. See pre-formed body 10 and wax coating 11. Body 10 is schematically shown in the form a golf club head. Body 10 is typically formed of ceramic material, as for example ceramic particles bonded together as by synthetic resin, in a known manner, to form a solid mass, which is frangible.

Step b) consists of forming a ceramic shell 12 about the wax shell, as by multiple dippings into ceramic slurry and allowing the latter to harden, about the wax, in successive layers.

Step c) consists of removing the wax shell by melting the wax, thereby to form an opened gap 13 between the ceramic shell 12 and the core body.

Figure 2:
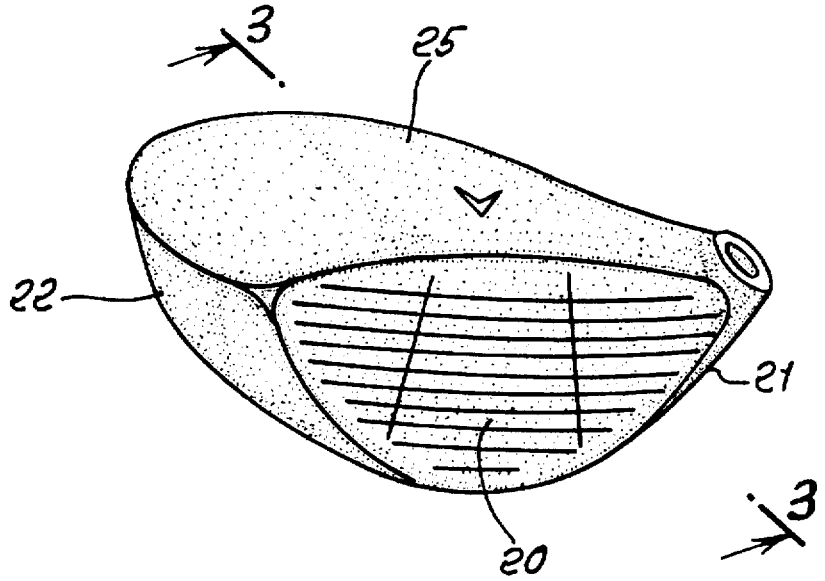
FIG. 2 is a perspective view of a golf club head.

Step d) consists of casting molten metal 14 into the opened gap 13 thereby to form product wall structure, allowed to solidify in situ. In the case of a hollow metallic golf club head as seen in FIGS. 2 and 3, such wall structure includes a front wall 20, a heel 21, a toe 22, a curved rear wall 23, a sole 24, and a top wall 25. Note that the integral sole wall 24, continuous with 20 and 23, is formed by this step, i.e. no large opening is left open at the sole location, whereby an additional step of welding a large sole plate to a large looping rim provided by the wall structure about the sole is eliminated, and problems associated with such welding are eliminated.

A relatively small port structure (a single port, dual ports, or other multiple ports) is formed and maintained at a location spaced from the sole 24. See for example port 16 formed through the downwardly curved rear wall 23 of the head structure, such rear wall curvature providing wall strength at the location of the relatively small port 16, whereby detrimental weakening of the wall structure is avoided. In the case of a golf club head, the port 16 is typically less than ½ square inch in cross sectional area. Also, its vertical height "h" is made substantially less than its horizontal length "1", to minimize any weakening of the wall structure. See FIG. 7. Rear wall 23, in which ports 16 are formed, is bi-directionally curved, i.e. in both a vertical plane, (the plane of FIG. 3) and a horizontal plane 17, in ball address position of the head.

Step e) consists of removing the frangible ceramic shell 12, as by cracking, from the solidified metallic wall structure, in the form of a metallic shell shown at 30, and also removing the core body 10 from within the metallic shell, as via the port 16 or ports, formed in the rear wall 23. In this regard, a tool may be passed through the port 16 and into the interior of the metal shell 30, to break-up the ceramic (or other material) core body 10 into small pieces, removed via port 16.

Preliminary steps to achieve the provided wax shell curved core body are shown in FIG. 1 at i), ii) and iii). Step i) consists of providing the pre-formed core body 10 itself. Such techniques are well known, and may include sintering a mass of ceramic particles held in shaped form by a resin binder. Step ii) consists of positioning the body 10 within a cavity 33 formed by mold structure 34, to provide an initial gap 35 between the body 10 and the cavity wall. Gap 35 corresponds to gap 13, referenced above. Small stand-offs or spacers 36 are typically located between the surface of body 10 and the mold cavity wall, to fix the gap 35 thickness. Step iii) consists of filling molten wax 11 into gap 35 to fill same, and about the stand-offs 36. After wax hardening, the mold structure 34 is removed. Note mold structure sections **34*a* and 34*b*, and parting line 34*b*** therebetween.

FIGS. 8 and **8*a*, related to step ii) above, show closed mold sections 40 and 41 with a parting line 42 therebetween. A mold cavity 33 is formed, and the preformed core body 10 is located in that cavity as by stand-offs or spacers 36, which may be glued to the mold body, as at locations 36*a*. A precision gap is thereby formed about the body 10. A peripheral recess 46 sunk in the mold body extends about the body in a plane 44 and intersects body surfaces corresponding to the ultimate head front wall, medialty of the sweet spot, head rear wall, head top wall, and the sole. See FIG. 5. The plane 44 approximately bisects the head. A stiffening rib 144 is thereby to be formed integrally with the head, at its inner side, as seen in FIG. 3**.

FIG. 9 corresponds to step iii) above, and shows wax shell 11 formed by molten wax reception into gap 35, as via a port 45 in mold section 40, in FIG. 8. Recess 46 is also filled with wax. Stand-offs or spacers 36 are removed, to produce openings **36*a*** in the wax shell.

FIG. 10 corresponds to step b) above, and shows formation of the layered ceramic shell 12 about the wax shell, as by successive dippings in a hydrated ceramic mix, such mixes being known. The liquid mix fills the openings **36*a*, as at 12*a*. The ceramic shell 12 is then allowed to harden, and solid ceramic stand-offs 12*aa* are thereby formed, to position the core 10** when the wax is removed.

FIG. 11 corresponds to steps c) and d) above and shows the ceramic shell 12 and core 10 positioned therein, after the wax is removed, to form a gap 13 therebetween. Ceramic stand-offs **12*a* are formed during dip formation of 12. Molten metal such as steel is then cast into the gap, as via a port 47 formed in shell 12, to form the metal head. Finally, the outer shell 12 is fractured and removed, along with stand-offs 12*a***.

An opening or openings 16 as described above are formed in the head rear wall to provide access to the head interior for fracturing and removing the core body 10. The small openings formed in the metal wall as by stand-offs 36 and corresponding ceramic stand-offs **12*a*, can be welded shut. If desired, stand-off 36 can be formed integrally with the ceramic body 10**.

In FIG. 7, two rear wall ports 16 are formed, at opposite sides of vertical plane 44. Those ports are located generally rearwardly of two dished recesses 50 and 51 formed in the sole wall, at opposite sides of a downwardly convex central ridge 52 that extends from front to rear, at generally the same level. Plane 44 bisects that ridge. Ports 16 also lie just above the level of rear wall bevel 53. The recesses 50 and 51, ridge 52 and bevel 53 may advantageously take the form as disclosed in U.S. Pat. application Ser. No. 08/263,970, filed Jun. 29, 1994, incorporated herein by reference. See also FIG. 12 herein, showing the bottom (sole area) of the latter, and with ports 16 formed in the lower rear wall. See also shaft 150 connected to the head. Ports 16 cannot be seen when the head is viewed from its top side. Ports 16 can be welded shut, if desired.

The metallic golf club head described has wall structure defining a front wall, a heel, a toe, a rear wall, a sole and a top wall, said head having at least one through opening formed in said rear wall at a level above the sole and so as to underlie a rear portion of the top wall.

I claim:

1. A hollow metallic golf club head having wall structure defining a front wall, a heel, a toe, a rear wall, a sole and a top wall, said rear wall having a downwardly curved portion, said head having at least one through opening formed in said rear wall downwardly curved portion at a level above the sole and so as to underlie a rear portion of the top wall, the front wall being entirely closed to block access into the hollow head via said front wall, said opening being elongated laterally.

2. The head of claim 1 having two of said through openings in said rear wall.

3. The head of claim 1 wherein said through opening has a cross sectional area less than 0.5 square inches.

4. The head of claim 1 wherein the head top, front and rear walls define inner sides, and including a looping rib integral with the head and located along certain of said inner sides.

5. The head of claim 2 wherein the head top, front and rear walls define inner sides, and including a looping rib integral with the head and located along certain of said inner sides, said rib defining an upright plane that passes between said two through openings.

* * * * *